US011429044B2

(12) United States Patent
Tsuruya et al.

(10) Patent No.: US 11,429,044 B2
(45) Date of Patent: Aug. 30, 2022

(54) FIXING APPARATUS AND IMAGE FORMING APPARATUS

(71) Applicant: CANON KABUSHIKI KAISHA, Tokyo (JP)

(72) Inventors: Takaaki Tsuruya, Shizuoka (JP); Yuki Nishizawa, Kanagawa (JP); Minoru Hayasaki, Shizuoka (JP); Aoji Isono, Kanagawa (JP); Akira Kuroda, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/156,337

(22) Filed: Jan. 22, 2021

(65) Prior Publication Data

US 2021/0232073 A1 Jul. 29, 2021

(30) Foreign Application Priority Data

Jan. 27, 2020 (JP) ..... JP2020-010967

(51) Int. Cl.
*G03G 15/20* (2006.01)

(52) U.S. Cl.
CPC ..... *G03G 15/2053* (2013.01); *G03G 15/2042* (2013.01); *G03G 15/2064* (2013.01)

(58) Field of Classification Search
CPC ..... G03G 15/2017; G03G 15/2053; G03G 2215/2003
See application file for complete search history.

(56) References Cited

U.S. PATENT DOCUMENTS

2016/0026132 A1* 1/2016 Hirai ..... H05B 6/145 399/69
2016/0313683 A1* 10/2016 Nishizawa ..... G03G 15/2042
2019/0018350 A1* 1/2019 Usui ..... H05B 6/145
2020/0103800 A1* 4/2020 Nishizawa ..... H05B 6/14
2021/0003948 A1* 1/2021 Isono ..... G03G 15/2053

FOREIGN PATENT DOCUMENTS

JP 2015118232 A 6/2015
JP 2017223820 A 12/2017
JP 2018066808 A 4/2018
JP 2018066810 A 4/2018

* cited by examiner

*Primary Examiner* — Thomas S Giampaolo, II
(74) *Attorney, Agent, or Firm* — Canon U.S.A., Inc. I.P. Division

(57) ABSTRACT

A fixing apparatus includes a rotary member including a heat-generation layer with a plurality of rings, a temperature detecting portion configured to detect a temperature of the rotary member, a conduction detecting unit configured to detect a conduction failure in an opposing ring that is one of the plurality of rings of the heat-generation layer and that opposes the temperature detecting portion, and a controller configured to control the supply of power to the magnetic field generator. The conduction detecting unit includes a first magnetic core, a second magnetic core, and a current detecting portion that includes a detection coil. A length of one of the first magnetic core and the second magnetic core around which the detection coil is wound is less than a length of another of the first magnetic core and the second magnetic core around which the detection coil is not wound.

10 Claims, 12 Drawing Sheets

FIXING APPARATUS AND IMAGE FORMING APPARATUS

BACKGROUND

Field of the Disclosure

The present disclosure relates to a fixing apparatus used in an image forming apparatus of an electrophotographic system or the like, and to an image forming apparatus including the fixing apparatus.

Description of the Related Art

In recent years, a fixing apparatus of an induction heating system that causes a heat-generation layer provided in a heating member to directly generate heat by electromagnetic induction is proposed. Japanese Patent Laid-Open No. 2015-118232 discloses a fixing apparatus of a system in which an energizing coil and a magnetic core are disposed inside a cylindrical rotary member, an alternating magnetic field is generated in a rotation axis direction of the rotary member, and thus heat is generated in the heat-generation layer by a circulating current generated in the circumferential direction of the rotary member.

In addition, a fixing apparatus of a thermal fixation system includes a temperature detecting element capable of detecting an abnormal temperature for blocking supply of power to a heating mechanism from the viewpoint of safety in the case where the temperature of a heating member reaches the abnormal temperature which is out of a normal use range.

The heat-generation layer of the rotary member disclosed in the document described above is formed from a heat-generation pattern made up of a plurality of regions divided in the rotation axis direction. Therefore, if a conduction failure in the circumferential direction occurs in one of the regions constituting the heat-generation pattern, the circulating current does not flow in that region and therefore heat is not generated in that region. Further, if the conduction failure occurs at a position corresponding to the position of the temperature detecting element that detects the abnormal temperature, the temperature detected by the temperature detecting element does not rise even though heat is generated in the other regions of the heat-generation layer, and therefore there is a risk that the supply of power is not blocked even when the temperature of the rotary member is raised to the abnormal temperature.

SUMMARY

An aspect of the present disclosure provides a fixing apparatus and an image forming apparatus in which abnormal temperature rise can be more reliably suppressed According to one aspect of the disclosure, a fixing apparatus is configured to heat a toner image on a recording material and fix the toner image to the recording material. The fixing apparatus includes a rotary member that is cylindrical, includes a heat-generation layer, and is configured to come into contact with the recording material, the heat-generation layer being conductive and including a plurality of rings each continuous in the circumferential direction of the rotary member, the plurality of rings being electrically separated from one another in a rotation axis direction of the rotary member, a magnetic field generator disposed on an inner circumferential side of the rotary member and configured to, by being supplied an alternating current, generate an alternating magnetic field to induce a circulating current flowing in the circumferential direction in each of the plurality of rings of the heat-generation layer, a temperature detecting portion configured to detect a temperature of the rotary member, a conduction detecting unit configured to detect a conduction failure in an opposing ring that is one of the plurality of rings of the heat-generation layer and that opposes the temperature detecting portion, and a controller configured to control supply and interruption of power to the magnetic field generator on a basis of detection results of the temperature detecting portion and the conduction detecting unit. The conduction detecting unit includes a first magnetic core disposed on an outer circumferential side of the rotary member, a second magnetic core disposed on the inner circumferential side of the rotary member and configured to form, together with the first magnetic core, a magnetic path surrounding the circulating current flowing in the opposing ring, and a current detecting portion that includes a detection coil wound around one of the first magnetic core and the second magnetic core and that is configured to output a signal corresponding to the circulating current flowing in the opposing ring. A length in the rotation axis direction of the one of the first magnetic core and the second magnetic core around which the detection coil is wound is smaller than a length in the rotation axis direction of another of the first magnetic core and the second magnetic core around which the detection coil is not wound.

Further features of the present disclosure will become apparent from the following description of exemplary embodiments with reference to the attached drawings.

DESCRIPTION OF THE EMBODIMENTS

An exemplary embodiment of the present disclosure will be described below with reference to drawings.

Image Forming Apparatus

Figure 1:
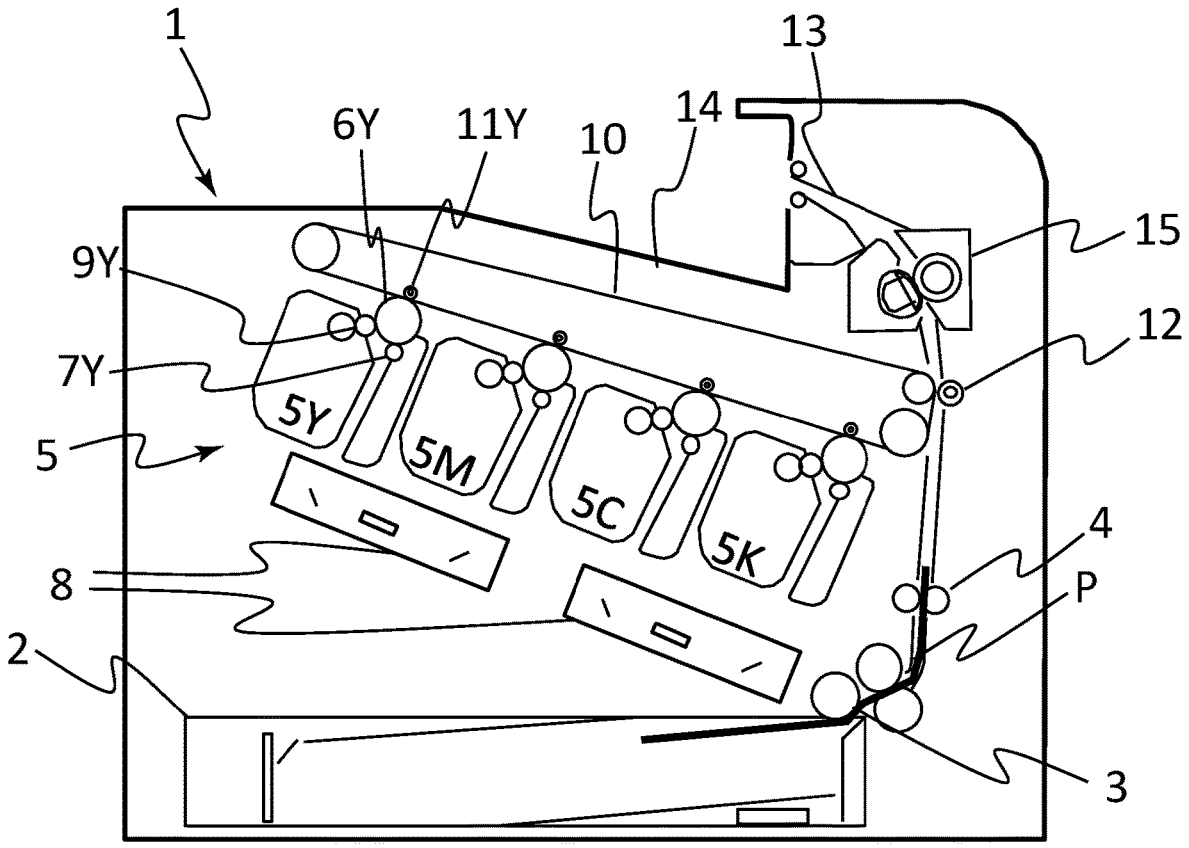
FIG. 1 is a schematic view of an image forming apparatus according to an embodiment of the present disclosure.

FIG. 1 is a cross-sectional view of a color laser beam printer 1 serving as an image forming apparatus including a fixing apparatus 15 serving as an image heating apparatus according to the embodiment illustrating an overall configuration thereof. The color laser beam printer 1 will be hereinafter simply referred to as a printer 1. A cassette 2 is accommodated in a lower portion of the printer 1 such that the cassette 2 can be drawn out. The cassette 2 accommodates sheets P that are stacked and serve as recording materials. The sheets P in the cassette 2 are fed to a registration roller 4 one sheet at a time by being separated from one another by a separation roller 3. To be noted, as the sheets P serving as recording materials, various sheets of different sizes and materials can be used. For example, paper sheets such as plain paper and cardboards, plastic films, cloths, surface-treated sheet materials such as coated paper sheets, and sheet materials of irregular shapes such as envelopes and index sheets can be used.

The printer 1 includes an image forming portion 5 serving as an image forming unit in which image forming stations 5Y, 5M, 5C, and 5K respectively corresponding to yellow, magenta, cyan, and black and arranged in parallel in the lateral direction. The image forming station 5Y includes a photosensitive drum 6Y, which is an electrophotographic photosensitive member, i.e., an image bearing member, and a charging roller 7Y serving as a charging member that uniformly charges the surface of the photosensitive drum 6Y. Further, scanner units 8 are provided in a lower portion of the image forming portion 5. The scanner units 8 irradiate the photosensitive drum 6Y with a laser beam that is on/off-modulated in accordance with a digital image signal generated by an image processing portion from image information input from an external device such as an unillustrated computer, and thus forms an electrostatic latent image on the photosensitive drum 6Y. Further, the image forming station 5Y includes a developing roller 9Y serving as a developing member that develops the electrostatic latent image on the photosensitive drum 6Y into a toner image by applying toner thereto, and a primary transfer portion 11Y that transfers the toner image on the photosensitive drum 6Y onto an intermediate transfer belt 10.

Toner images formed in the other image forming stations 5M, 5C, and 5K in substantially the same processes with the image forming station 5Y are transferred so as to be superimposed on the toner image on the intermediate transfer belt 10 transferred at the primary transfer portion 11Y, and thus a full-color toner image is formed on the intermediate transfer belt 10. The full-color toner image is transferred onto a sheet P by a secondary transfer portion 12 serving as a transfer member. Then, the toner image on the sheet P serving as a recording material passes through a fixing apparatus 15, and is fixed as a fixed image. Then, the sheet P is discharged onto a supporting portion 14 via a discharge conveyance portion 13 and is supported on the supporting portion 14.

To be noted, the image forming portion 5 described above is merely an example of an image forming unit. For example, a direct transfer system in which a toner image is directly transferred from an image bearing member onto the sheet P may be employed, and a monochromatic system in which only toner of one color is used may be employed.

Fixing Apparatus

Figure 2:
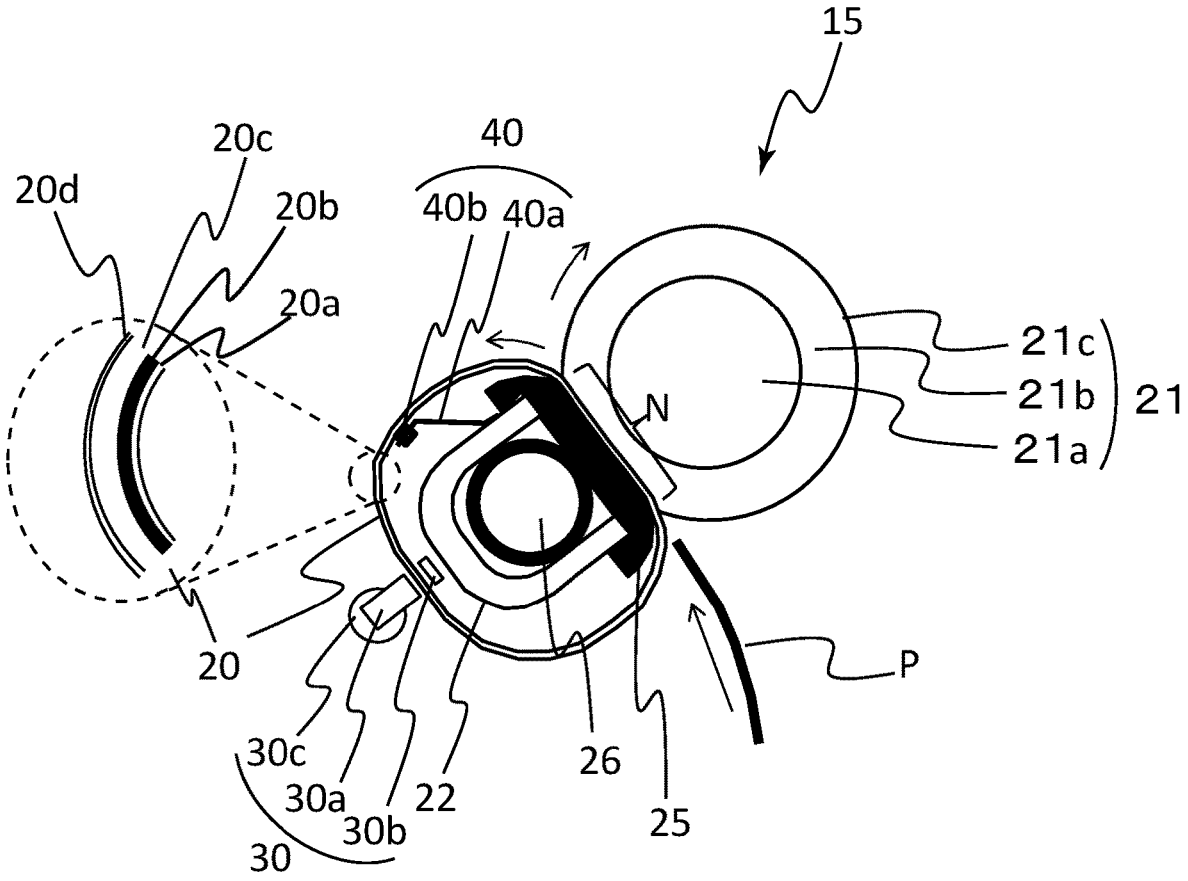
FIG. 2 is a schematic diagram illustrating a sectional configuration of a fixing apparatus according to the embodiment.
Figure 3:
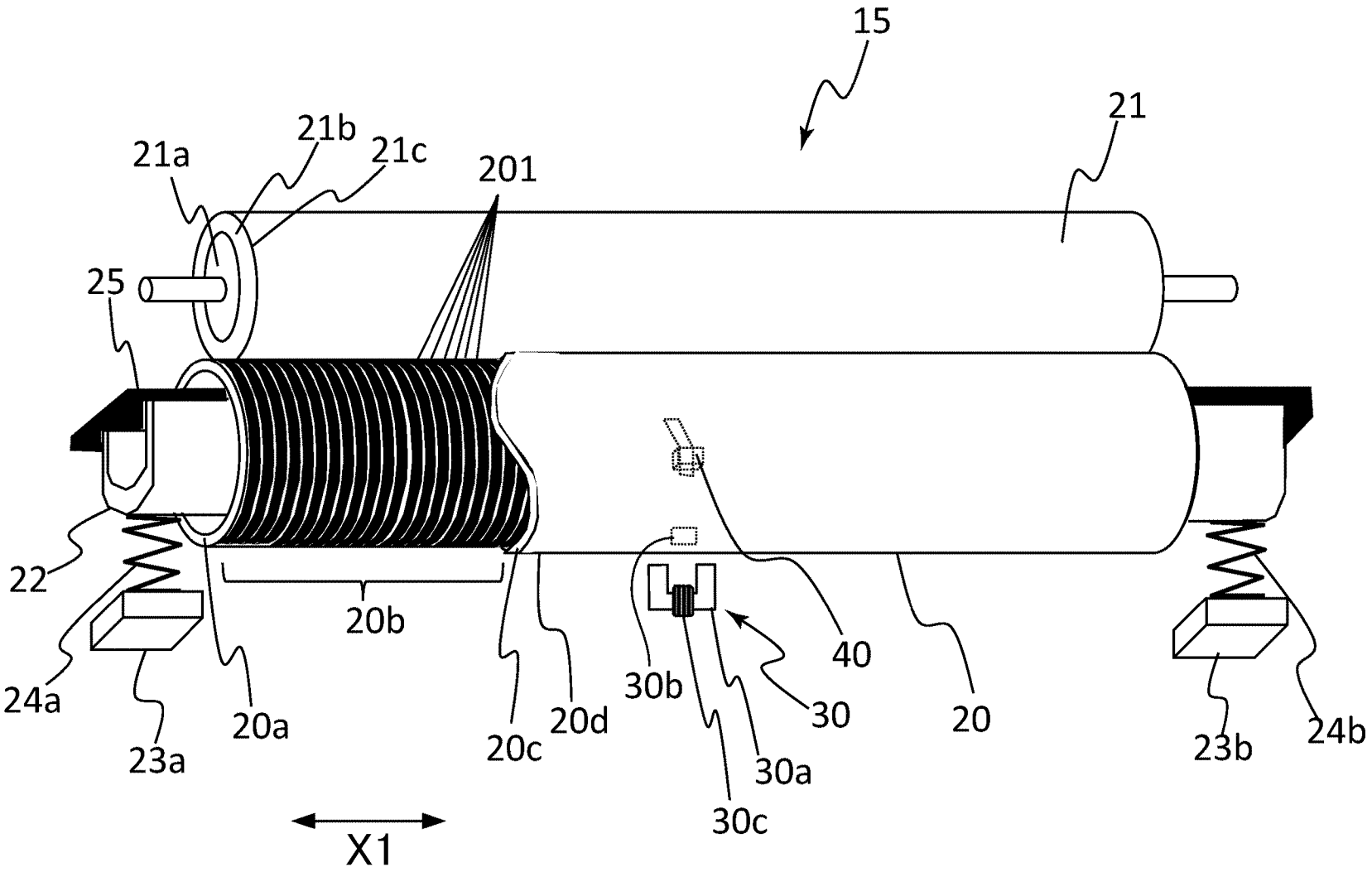
FIG. 3 is a schematic view of the fixing apparatus according to the embodiment.

The fixing apparatus 15 of the present embodiment is a fixing apparatus of an induction heating system serving as an image heating apparatus. FIG. 2 illustrates a sectional configuration of the fixing apparatus 15, and FIG. 3 is a perspective view of the fixing apparatus 15. To be noted, illustration of a casing and so forth of the fixing apparatus 15 is omitted in FIGS. 2 and 3. In the description below, a longitudinal direction X1 with respect to members constituting the fixing apparatus 15 is a direction perpendicular to the conveyance direction of the recording material and to the thickness direction of the recording material.

Figure 4:
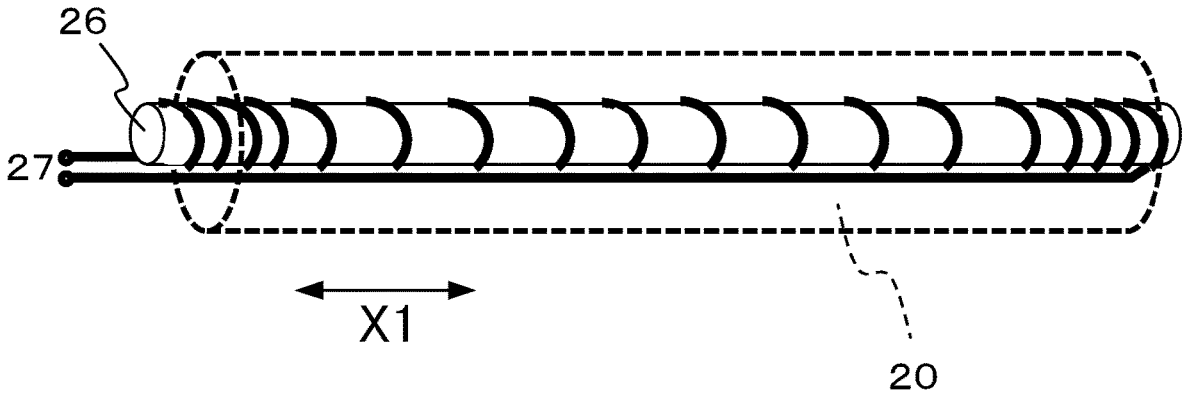
FIG. 4 is a schematic view of a magnetic core and an energizing coil of the fixing apparatus according to the embodiment.

The fixing apparatus 15 includes a fixing film 20, a film guide 25, a pressurizing roller 21, a pressurizing stay 22, a magnetic core 26, an energizing coil 27 illustrated in FIG. 4, a thermistor 40, and a current sensor 30. The fixing film 20 serves as a rotary member of the present embodiment, and the pressurizing roller 21 serves as an opposing member of the present embodiment. In addition, the energizing coil 27 functions as a magnetic field generator of the present embodiment.

The fixing film 20 is a flexible rotary member having a cylindrical shape (i.e., tubular shape) and includes a base layer 20*a*, a heat-generation layer 20*b* serving as a heat-generation member, an elastic layer 20*c*, and a mold releasing layer 20*d* in this order from the inner circumferential side to the outer circumferential side. The base layer 20*a* is formed from a heat-resistant insulating resin such as polyimide, polyamide-imide, polyether ether ketone: PEEK, or polyethersulfone: PES. In the present embodiment, the base layer 20*a* having a cylindrical shape of an inner diameter of 30 mm, a length in the longitudinal direction X1 of 240 mm, and a thickness of about 60 μm was made by molding a polyimide resin.

The heat-generation layer 20*b* is formed into a heat-generation pattern in which heat-generation rings 201 illustrated in FIG. 3 are arranged in the longitudinal direction X1. The heat-generation rings 201 are each formed as unbroken rings and are electrically separated from one another in the longitudinal direction X1. That is, the heat-generation layer 20*b* is divided into a plurality of ring-shaped regions serving as a plurality of rings that are each connected in the circumferential direction of the fixing film 20 and are electrically separated from one another in the rotation axis direction of the fixing film 20. The heat-generation rings 201 serving as constituent elements of the heat-generation pattern are each formed to have a constant width in the longitudinal direction X1.

Preferable examples of the material for the heat-generation layer 20*b* include materials having good electrical conductivity such as iron, copper, silver, aluminum, nickel, chromium, tungsten, alloys including these such as SUS304 (18Cr-8Ni stainless steel) and nichrome, carbon fiber-reinforced plastics: CFRP, and carbon nanotube resin. Examples of methods for forming the heat-generation pattern include printing, plating, sputtering, and vapor deposition, and in the present embodiment, the heat-generation rings 201 each had a width of 3 mm in the longitudinal direction X1 were arranged at intervals of 0.1 mm. In addition, these heat-generation rings 201 were formed as a nickel layer having a thickness of about 5 μm by electroless plating.

The elastic layer 20*c* is preferably formed from a material having high heat resistance and high thermal conductivity such as silicone rubber, fluorine rubber, or fluorosilicone rubber. In the present embodiment, the elastic layer 20*c* having a thickness of about 300 μm was formed from silicone rubber.

It is preferable that a material having high mold releasability and high heat resistance such as polyfluoroalkyl alkane: PFA, polytetrafluoroethylene: PTFE, or fluorinated ethylene propylene: FEP is selected. In the present embodiment, the mold releasing layer 20*d* having a thickness of about 15 μm was formed by covering the elastic layer 20*c* with a PFA resin tube. Here, PFA is a copolymer of tetrafluoroethylene and perfluoroalkyl vinyl ether, and FEP is a copolymer of tetrafluoroethylene and hexafluoropropylene.

The pressurizing roller 21, which is a pressurizing member serving as an opposing member opposing the fixing film 20 includes a core metal 21*a*, an elastic layer 21*b* formed coaxially to and around the core metal 21*a* in a roller shape to cover the core metal 21*a*, and a mold releasing layer 21*c* serving as a surface layer. The elastic layer 21*b* is preferably formed from a material having high heat resistance such as silicone rubber, fluorine rubber, or fluorosilicone rubber. Further, end portions of the core metal 21*a* in the longitudinal direction X1 are rotatably held by unillustrated chassis side metal plates of the apparatus via conductive bearings.

In addition, as illustrated in FIG. 3, pressurizing springs 24*a* and 24*b* are respectively provided between end portions of the pressurizing stay 22 in the longitudinal direction X1 and spring receiving members 23*a* and 23*b* are provided on the apparatus chassis side in a compressed state, and thus, a downward pushing force is applied to the pressurizing stay 22. A pressing force of about 100 N to 300 N (10 kgf to 30 kgf) in total is applied in the fixing apparatus 15 of the present embodiment. As a result of this, a lower surface of the film guide 25 formed from polyphenylene sulfide: PPS, which is a heat resistant resin, or the like comes into pressure contact with an upper surface of the pressurizing roller 21 with the fixing film 20 serving as a cylindrical rotary member therebetween, and thus, a fixing nip portion N of a predetermined width is formed. The film guide 25 functions as a nip portion forming member that forms a nip portion in which a recording material bearing a toner image is nipped and conveyed via the fixing film 20, together with the pressurizing roller 21.

The pressurizing roller 21 is rotationally driven in a clockwise direction in FIG. 2 by an unillustrated driving unit, and thus, a rotational force in a counterclockwise direction derived from a frictional force between the pressurizing roller 21 and the outer surface of the fixing film 20 is applied to the fixing film 20. As a result of this, the fixing film 20 rotates while rubbing the film guide 25.

FIG. 4 is a schematic view of the magnetic core 26 and the energizing coil 27 illustrated in FIG. 2, and the fixing film 20 is indicated by a broken line for describing the positional relationship with the fixing film 20. The magnetic core 26 is inserted in a hollow portion, that is, an inner space of the fixing film 20, which is a cylindrical rotary member. The energizing coil 27 is wound around the outer circumferential surface of the magnetic core 26 in a spiral shape and extends in the longitudinal direction X1. The magnetic core 26 has a columnar shape and is, by an unillustrated fixing member, fixed to a position approximately at the center of the fixing film 20 in section view as viewed in the longitudinal direction X1 as illustrated in FIG. 2.

The magnetic core 26 provided inside the energizing coil 27 induces magnetic field lines, that is, a magnetic flux of an alternating magnetic field generated by the energizing coil 27 on the inner circumferential side of the heat-generation layer 20*b* of the fixing film 20, and thus, forms a path of magnetic field lines, that is, a magnetic path. The magnetic core 26 is preferably formed from a material having a small hysteresis loss and high relative magnetic permeability, for example, a soft magnetic material having high magnetic permeability such as sintered ferrite or ferrite resin. The sectional shape of the magnetic core 26 may be any shape as long as the magnetic core 26 can be accommodated in the hollow portion of the fixing film 20, and although the sectional shape does not have to be circular, a shape whose sectional area is as large as possible is preferred. In the present embodiment, the magnetic core 26 had a diameter of 10 mm and a length in the longitudinal direction X1 of 280 mm.

The energizing coil 27 was formed by winding a copper wire coated with heat-resistant polyamide-imide and having a diameter of 1 to 2 mm around the magnetic core 26 about 20 times. The copper wire is an example of a wire made of a single conductive material. The energizing coil 27 is wound around the magnetic core 26 in a direction intersecting with the rotation axis direction of the fixing film 20. Therefore, when an alternating current of high frequency is supplied to the energizing coil 27, an alternating magnetic field is generated in a direction parallel to the rotation axis direction, and therefore, an induced current, which is a circulating current, flows in each heat-generation ring 201 of the heat-generation layer 20*b* of the fixing film 20 by the principle of electromagnetic induction as described later, and heat is generated.

As illustrated in FIGS. 2 and 3, the thermistor 40 serving as a temperature detecting portion that detects the temperature of the fixing film 20 is constituted by a spring plate 40*a* and a thermistor element 40*b*. The spring plate 40*a* is a supporting member having spring elasticity and extending toward the inner circumferential surface of the fixing film 20. The thermistor element 40*b* serving as a temperature detecting element is disposed at a distal end portion of the spring plate 40*a*. The surface of the thermistor element 40*b* is covered with a polyimide tape having a thickness of 50 μm to secure electrical insulation.

The thermistor 40 is fixed to the film guide 25 so as to be positioned at approximately the center of the fixing film 20 in the longitudinal direction X1. Further, the thermistor element 40*b* is pressed against and is held in a contacted state with the inner circumferential surface of the fixing film 20 by the spring elasticity of the spring plate 40*a*. To be noted, the thermistor 40 may be disposed on the outer circumferential side of the fixing film 20.

The current sensor 30 constituting a conduction monitoring device that monitors the conduction in the circumferential direction of the heat-generation layer 20*b* is disposed at the same position as the thermistor 40 in the longitudinal direction X1 of the fixing apparatus 15. That is, the current sensor 30 monitors the conduction state of a heat-generation ring 201 provided at a position where the thermistor element 40*b* is in contact with the fixing film 20. The principle and configuration of the current sensor 30 will be described in detail later.

Heating Principle

Figure 5:
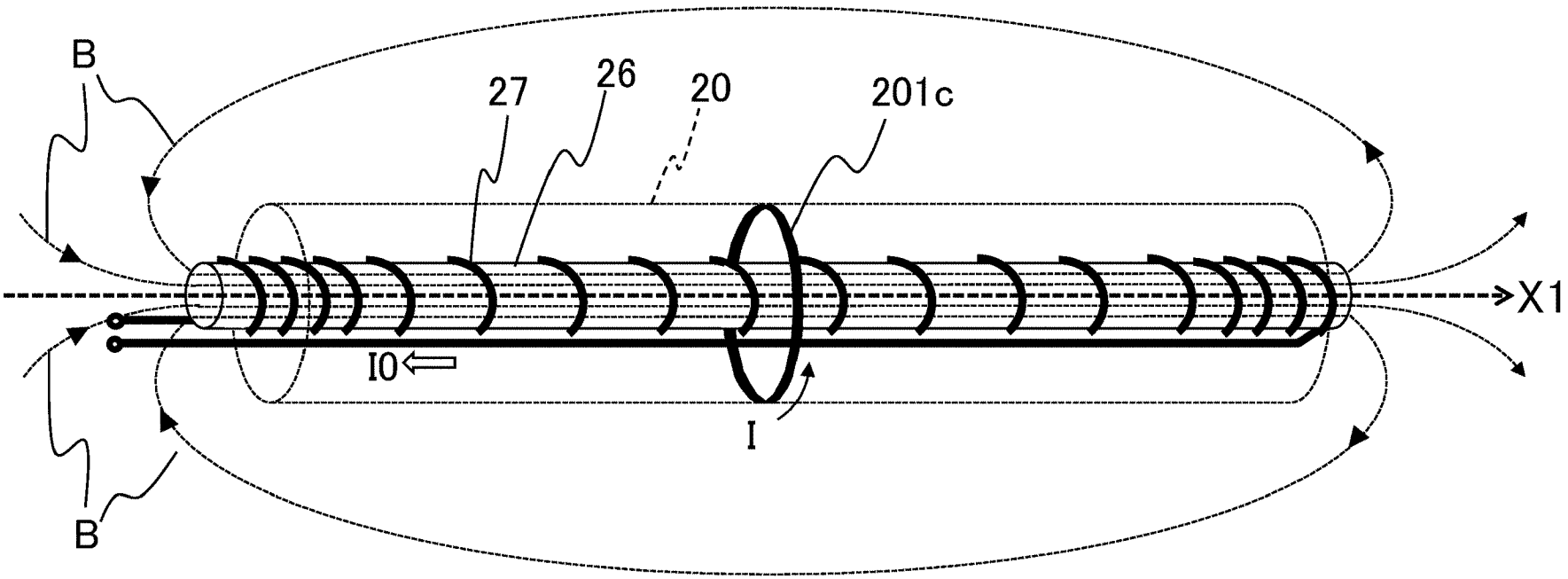
FIG. 5 is a diagram illustrating a magnetic field formed when a current is supplied to the energizing coil according to the embodiment.

A heating principle of the fixing film 20 in the fixing apparatus 15 of an induction heating system will be described. FIG. 5 is a conceptual diagram illustrating a moment in which a current is increasing in the energizing coil 27 in an arrow 10 direction. The energizing coil 27, which functions as a magnetic field generator, and is inserted in the fixing film 20, generates an alternating magnetic field in the rotation axis direction of the fixing film 20 when an alternating current is supplied thereto, and thus, generates an induced current I in the circumferential direction of the fixing film 20. In addition, the magnetic core 26 functions as a member that guides magnetic field lines B indicated by dotted lines and generated by the energizing coil 27 and forms a magnetic path.

When an alternating magnetic field is formed by the energizing coil 27, the induced current I according to Faraday's law flows in each heat-generation ring 201 of the heat-generation layer 20*b* of the fixing film 20. Faraday's law states that "when a magnetic field in a circuit is changed, an induced electromotive force that acts to generate a current in the circuit is generated, and the induced electromotive force is proportional to temporal change of a magnetic flux perpendicularly passing through the circuit".

The induced current I that flows in a heat-generation ring 201*c* in the case where an alternating current of a high frequency is supplied to the energizing coil 27 is assumed. The heat-generation ring 201*c* is positioned at a center portion in the longitudinal direction X1 of the magnetic core 26 illustrated in FIG. 5. In the case where an alternating current of a high frequency is supplied, an alternating magnetic field is formed in the magnetic core 26. The induced electromotive force that acts on the heat-generation ring 201*c* at this time is proportional to the temporal change of a magnetic flux perpendicularly passing through the inside of the heat-generation ring 201*c* in accordance with the following formula 1.

$$V = -N\frac{\Delta\Phi}{\Delta t}$$

V: induced electromotive force

N: number of turns of coil $\Delta\Phi/\Delta t$: temporal change of magnetic flux perpendicularly passing through the circuit (heat-generation ring 201*c*) in a minute time $\Delta t$ This induced electromotive force V generates the induced current I, that is a circulating current that circulates in the heat-generation ring 201*c*, and the heat-generation ring 201*c* generates heat as Joule heat generated by the induced current I. However, in the case where there is a breakage within the heat-generation ring 201*c*, the induced current I does not flow and the heat-generation ring 201*c* does not generate heat.

Abnormal Temperature Rise Suppression Control

Figure 6:
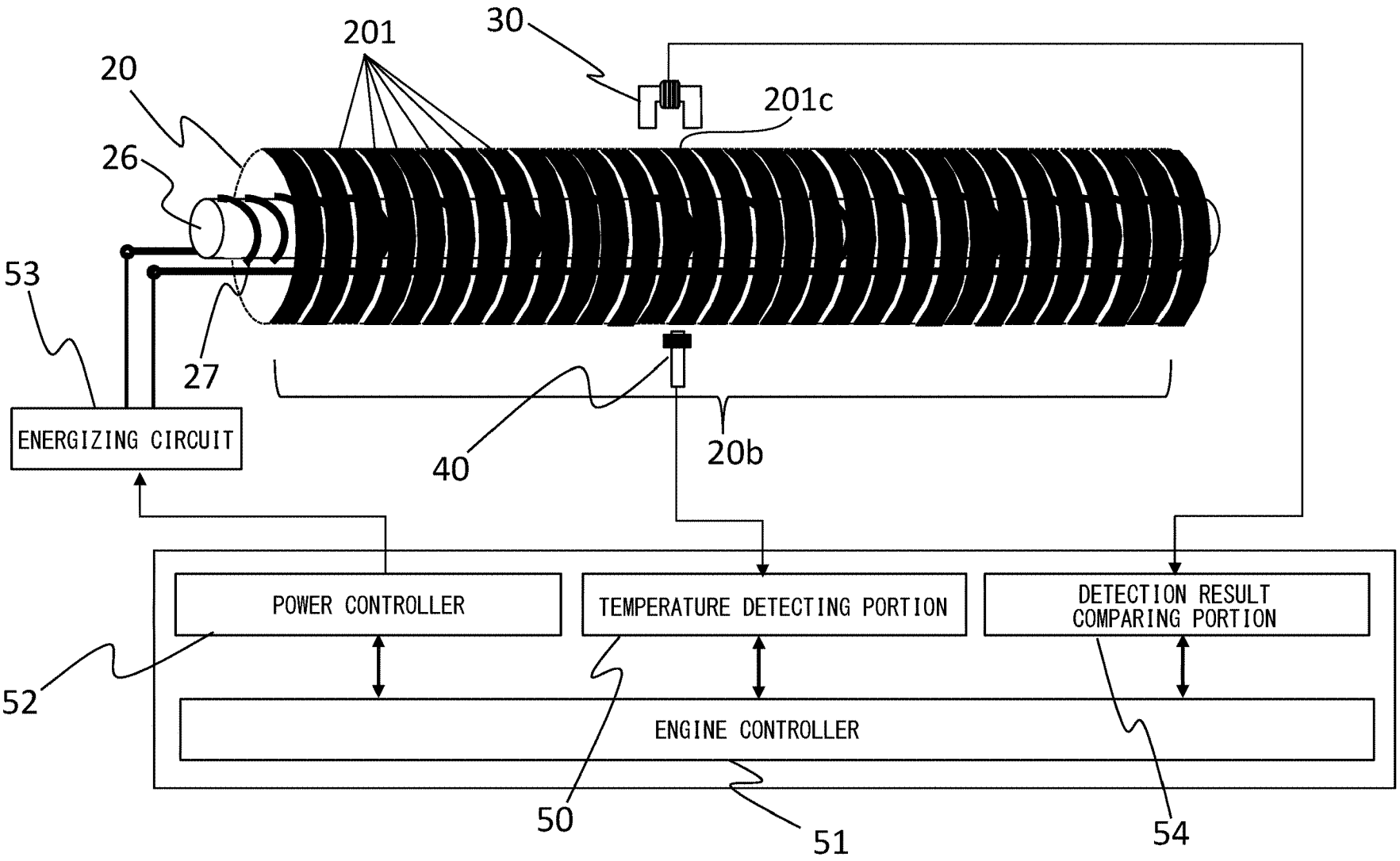
FIG. 6 is a block diagram illustrating a control configuration of the fixing apparatus according to the embodiment.

FIG. 6 is a conceptual diagram for describing a configuration for performing control for suppressing increase of temperature of the fixing film 20 to an abnormal temperature by using the thermistor 40 and the current sensor 30. This control will be hereinafter referred to as abnormal temperature rise suppression control. To be noted, although the thermistor 40 of the present disclosure is disposed on the inner circumferential side of the fixing film 20, the thermistor 40 is illustrated on the outer circumferential side of the fixing film 20 in FIG. 6 for better visibility.

The thermistor 40 is connected to a temperature detecting portion 50. The temperature detecting portion 50 detects an inner surface temperature of the fixing film 20 as an electric signal input from the thermistor 40, and this electric temperature information is input to an engine controller 51. The engine controller 51 calculates power to be input to the fixing apparatus 15, and supplies a high-frequency current to the energizing coil 27 from an energizing circuit 53 via a power controller 52. In this manner, the temperature of the fixing film 20 is adjusted to and maintained at a predetermined target temperature. The target temperature is normally set within a range of about 150° C. to 200° C.

Further, in the case where information indicating that the temperature of the fixing film 20 is equal to or higher than a predetermined temperature higher than the setting range of the target temperature, for example, equal to or higher than 220° C., is input to the engine controller 51 from the temperature detecting portion 50, the engine controller 51 determines that the fixing film 20 is in an abnormal temperature rise state. In this case, the engine controller 51 serving as a controller or a blocking portion prohibits supply of power to the fixing apparatus 15, that is, blocks a driving voltage supplied from the energizing circuit 53 to the energizing coil 27, and emergency-stops the image forming operation.

Here, the current sensor 30 is disposed at a position corresponding to the position of the thermistor 40 in the longitudinal direction X1 of the fixing apparatus 15, that is, the rotation axis direction of the fixing film 20. For example, the difference between the center position of an outer magnetic core 30*a*, which will be described later, in the longitudinal direction X1 and the center position of the thermistor element 40*b* in the longitudinal direction X1 is preferably smaller than the width of the heat-generation ring 201, and is more preferably smaller than a half of the width of the heat-generation ring 201. In the present embodiment, the current sensor 30 and the thermistor 40 are provided at the same position in the longitudinal direction X1 provided that the influence of inevitable positional deviation caused by component tolerance, assembly tolerance, and so forth is ignored.

Therefore, the output signal of the current sensor 30 has correlation with the magnitude of the circulating current flowing in the circumferential direction in the heat-generation ring 201*c* opposing the thermistor 40, i.e., opposing ring in the present embodiment, among the plurality of heat-generation rings 201 constituting the heat-generation layer 20*b* of the fixing film 20. The output signal of the current sensor 30 is input to a detection result comparing portion 54 as information related to the magnitude of the circulating current flowing in the heat-generation ring 201*c*. In the case where the amount of current obtained as the detection result of the current sensor 30 is equal to or less than a threshold value, the detection result comparing portion 54 determines that a conduction failure in the circumferential direction has occurred in the heat-generation ring 201*c* opposing the thermistor 40, and transmits a conduction failure detection signal to the engine controller 51. The engine controller 51 that has received the conduction failure detection signal prohibits supply of power to the fixing apparatus 15, and emergency-stops the image forming operation.

By prohibiting the supply of power to the fixing apparatus 15 in the case where a conduction failure is detected in the heat-generation ring 201*c*, occurrence of abnormal temperature rise of the fixing film 20, as a result of the temperature detected by the thermistor 40 not reflecting the fixing film 20, can be suppressed. That is, when a conduction failure occurs in the heat-generation ring 201*c* opposing the thermistor 40, which is one of the ring-shaped regions (plurality of rings) constituting the heat-generation layer 20*b*, the circulating current does not flow and therefore heat is not generated in that region. In this case, the temperature detected by the thermistor 40 does not rise even though the other heat-generation rings 201 generate heat, and therefore there is a possibility that suppressing the abnormal temperature rise of the fixing film 20 is failed if detection of the abnormal temperature rise depends only on the thermistor 40. In contrast, in the present embodiment, the supply of power to the fixing apparatus 15 is prohibited, that is, blocked even in the case where the heat-generation ring 201*c* does not generate heat, and therefore the abnormal temperature rise of the fixing film 20 can be more reliably suppressed.

Here, in the case where a conduction failure occurs in a heat-generation ring 201 other than the heat-generation ring 201*c* opposing the thermistor 40, the temperature of a part of the fixing film 20 corresponding to the heat-generation ring other than the heat-generation ring 201*c* becomes lower than that of the surroundings thereof, and there is a possibility that a streak-shaped image defect occurs. However, since the temperature of the fixing film 20 is managed in a state in which at least the heat-generation ring 201*c* opposing the thermistor 40 is generating heat normally, there is no need to prohibit supply of power to the fixing apparatus 15 for suppressing the abnormal temperature rise of the fixing film 20.

Principle and Configuration of Conduction Monitoring Device (1) Principle of Conduction Monitoring Device The principle of the conduction monitoring device serving as a conduction detecting unit of the present embodiment will be described below. As described above, a circulating current generated by an induced electromotive force flows in the heat-generation layer 20*b* of the fixing film 20. The induced electromotive force is proportional to the temporal change of a magnetic flux Φ generated by the energizing coil 27 as expressed by the formula 1 described above. Since the magnetic flux Φ is proportional to the amount of current in the energizing coil 27, the induced electromotive force that acts on the heat-generation layer 20*b* can be obtained by measuring the current by connecting a typical current measurement circuit to the energizing coil 27. In contrast, the circulating current flowing in the heat-generation layer 20*b* cannot be measured by connecting a typical current measurement circuit.

Figure 7:
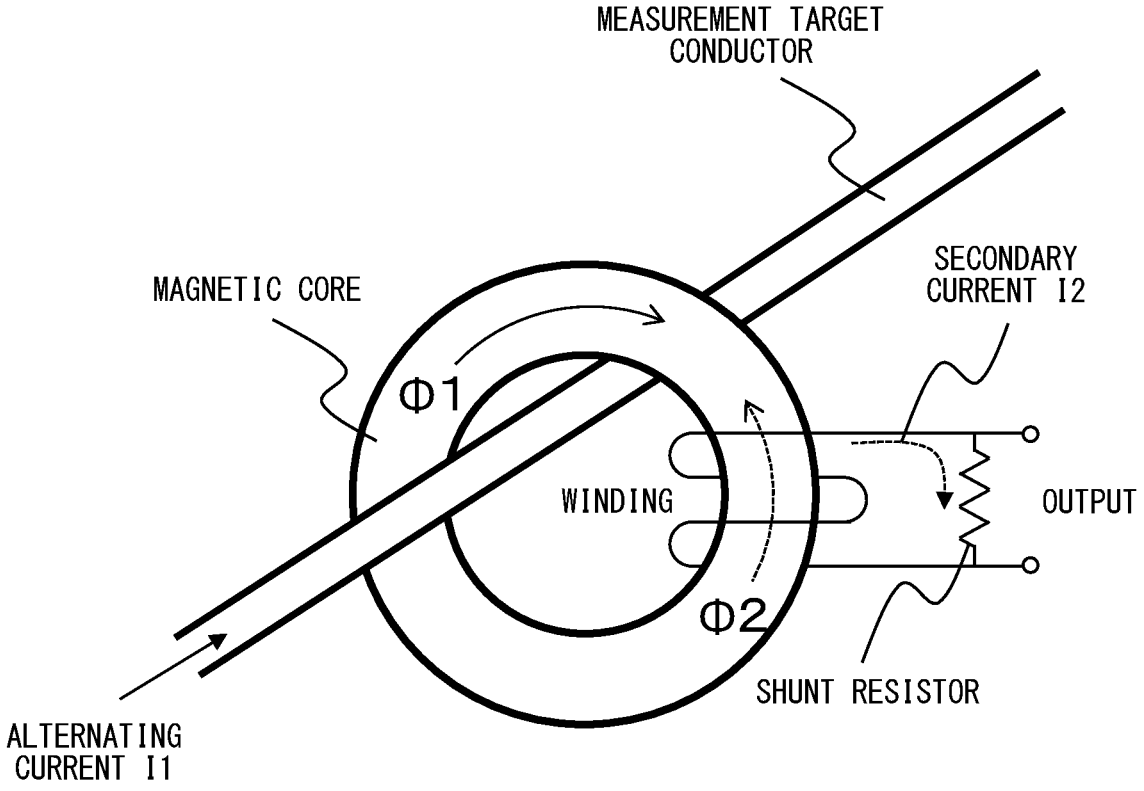
FIG. 7 is a diagram for describing a measurement principle of a current sensor of a CT system.

Therefore, in the present embodiment, the principle of a current sensor of a current transformer: CT type, which is a non-contact current sensor, is applied in the present embodiment. FIG. 7 is a diagram for describing a measurement principle of a CT current sensor. An alternating current I1 flowing in a measurement target conductor generates a magnetic flux Φ1 in a magnetic core. In a winding wound around the magnetic core, a secondary current I2 corresponding to a turn ratio flows and a voltage, that is, an electromotive force is generated at ends of a shunt resistor such that a magnetic flux Φ2 is generated in such a direction as to cancel the magnetic flux Φ1. Since this voltage is proportional to the alternating current I1 flowing in the measurement target conductor, the amount of current can be determined.

(2) Configuration of Conduction Monitoring Device

Figure 8:
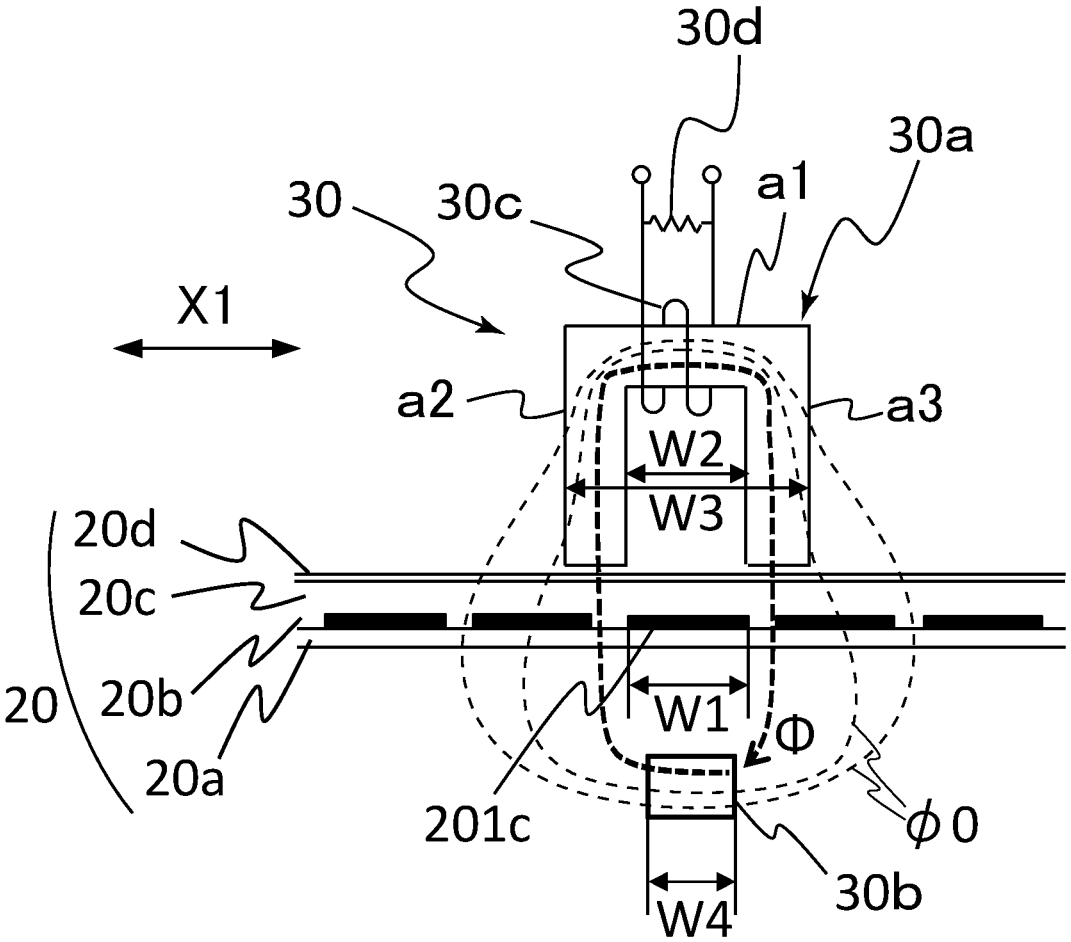
FIG. 8 is a schematic diagram illustrating a configuration of a current sensor according to Examples 1 and 2.
Figure 9:
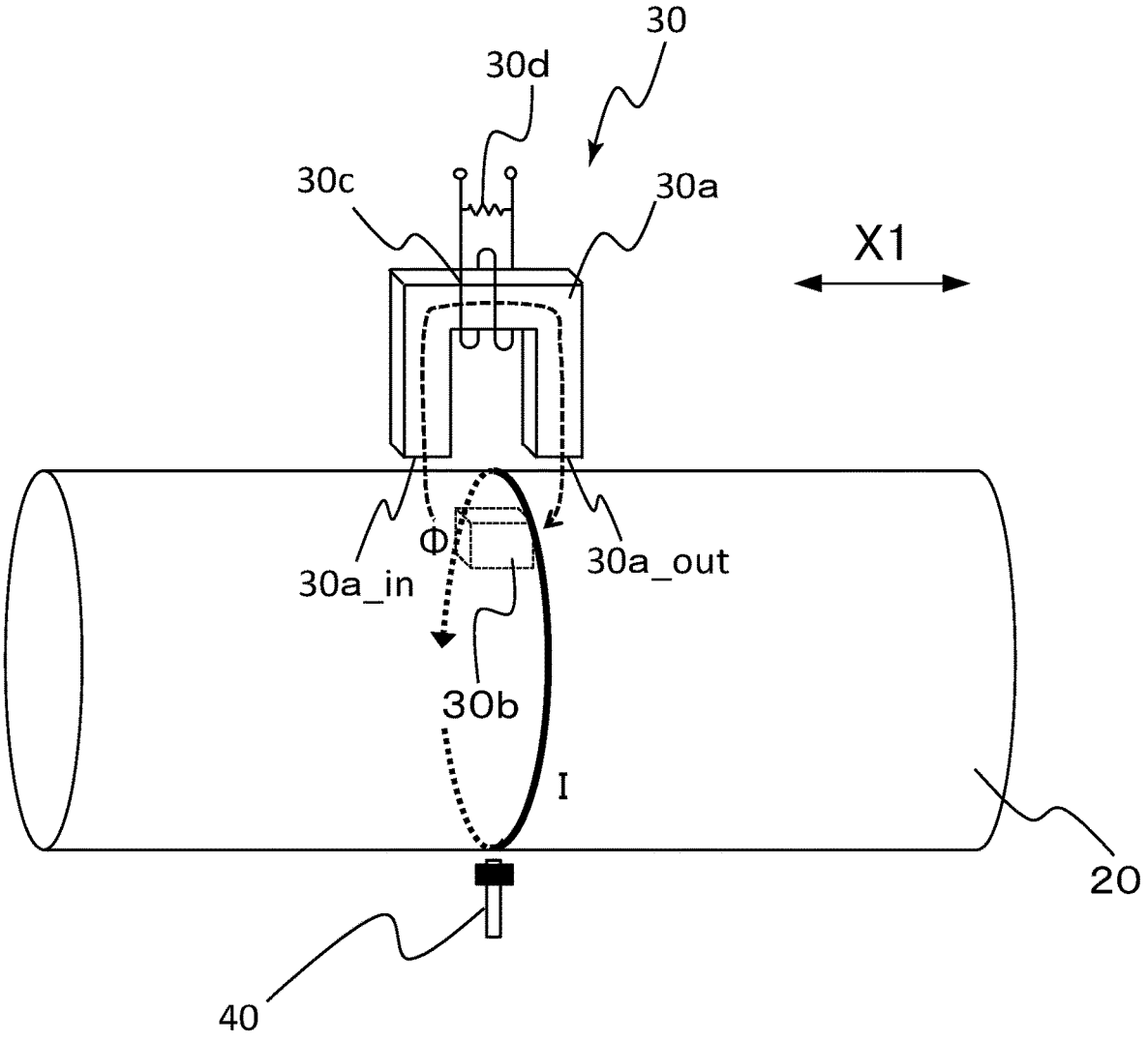
FIG. 9 is a schematic diagram illustrating a positional relationship between the current sensor and a thermistor according to Examples 1 and 2.

Next, a configuration of the conduction monitoring device according to the present embodiment will be described in detail. FIGS. 8 and 9 are respectively a section view and a perspective view of a current sensor 30 constituting the conduction monitoring device according to the present embodiment illustrating a configuration thereof.

In the present embodiment, a section taken along a circumferential direction in which an induced current flows in the fixing film 20, for example, a section viewed in the longitudinal direction X1 will be referred to as a first section. As a section intersecting with the first section, a section transverse to the induced current, for example, a section of FIG. 8 which is a section passes through one point of the heat-generation ring 201*c* and having, as the normal direction thereof, the tangential direction of the heat-generation ring 201*c* at the same point, will be referred to as a second section. A magnetic path forming portion is disposed such that a magnetic path surrounding the induced current is formed in the second section. Further, as a section intersecting with the second section, a section transverse to part of the magnetic path in the second section, for example, a section perpendicular to the longitudinal direction X1 and passing through a first portion a1 of the outer magnetic core 30*a* that will be described later will be referred to as a third section. The first section and the third section may be the same plane.

Further, by detecting the change in the magnetic flux crossing the third section by a winding wound around the magnetic path transverse to the third section, which corresponds to the winding illustrated in FIG. 7, the magnitude of the induced current intersecting with the second section can be obtained. That is, this winding and an ammeter or a voltmeter connected thereto function as a current detecting portion that outputs a signal correlated with the magnitude of the induced current intersecting with the second section, or an obtaining portion that obtains a current value or a voltage value corresponding to the magnitude of the induced current.

As the magnetic path forming portion, as illustrated in FIGS. 8 and 9, an outer magnetic core 30*a* serving as a first magnetic core and an inner magnetic core 30*b* serving as a second magnetic core are used. The outer magnetic core 30*a* is disposed on the outer circumferential side of the fixing film 20, and the inner magnetic core 30*b* is disposed on the inner circumferential side of the fixing film 20. The outer magnetic core 30*a* and the inner magnetic core 30*b* oppose each other with the fixing film 20 therebetween.

In the present embodiment, the outer magnetic core 30*a* has a U shape with right-angled corners, and the inner magnetic core 30*b* has an I shape, that is, a linear shape. The outer magnetic core 30*a* includes a first portion a1 extending in the longitudinal direction X1, a second portion a2 extending from a first end of the first portion a1 toward the fixing film 20, and a third portion a3 extending from a second end of the first portion a1 toward the fixing film 20. To be noted, among the magnetic cores included in the fixing apparatus 15, whereas the outer magnetic core 30*a* and the inner magnetic core 30*b* are provided for detecting breakage in the heat-generation layer 20*b* of the fixing film 20, the magnetic core 26 described above is related to induction heating of the fixing film 20.

As the current detecting portion or an obtaining portion, the detection coil 30*c* is wound around the outer magnetic core 30*a*, a shunt resistor 30*d* is connected to both ends of the detection coil 30*c*, and the potential difference, that is, the voltage between the both ends of the shunt resistor 30*d* is obtained as an output signal. Compared with the basic configuration of the CT current sensor illustrated in FIG. 7 described above, the configuration of the present embodiment is basically the same except that the magnetic core is divided to parts on the inside and outside of the fixing film 20. That is, according to the principle of the CT current sensor described above, an alternating current that is a secondary current corresponding to the turn ratio of the detection coil 30*c* flows in the detection coil 30*c* so as to cancel the generated magnetic flux, and voltage is generated between the ends of the shunt resistor 30*d*. Since this voltage is proportional to the circulating current flowing in the fixing film 20, the amount of circulating current flowing in the fixing film 20 can be determined by measuring the potential difference between the ends of the shunt resistor 30*d* by a typical voltmeter. That is, in the case where the circulating current flowing in the fixing film 20 obtained on the basis of the voltage value indicated by the voltmeter connected to the shunt resistor 30*d* is smaller than a predetermined threshold value, it can be determined that a conduction failure has occurred in the heat-generation ring 201*c*.

(3) Width and Detection Sensitivity of Detection Magnetic Core

One important element related to the configuration of the outer magnetic core 30*a* around which the detection coil 30*c* is wound is the positional relationship between the circulating current flowing in the fixing film 20 and positions of a magnetic flux entrance 30*a*_in and a magnetic flux exit 30*a*_out illustrated in FIG. 9 in the outer magnetic core 30*a* around which the detection coil 30*c* is wound. The magnetic flux entrance 30*a*_in and magnetic flux exit 30*a*_out preferably positioned such that the magnetic flux entrance 30*a*_in and the magnetic flux exit 30*a*_out oppose each other in the longitudinal direction X1 with a flow path of the induced current I serving as a monitoring target therebetween. Further, as illustrated in FIG. 8, it is preferable that a width W1 in the longitudinal direction X1 of the heat-generation ring 201*c* opposing the thermistor 40 is approximately equal to an inner width W2 in the longitudinal direction X1 of the outer magnetic core 30*a*, i.e., distance between the second portion a2 and the third portion a3. This is because, as can be seen from the measurement principle of the CT current sensor described above, the change in the amount of current at the time of breakage is greater in the case of detecting the amount of current in only the single heat-generation ring 201*c* whose breakage state is monitored. To be noted, in the present embodiment, the width in the longitudinal direction X1 of each heat-generation ring 201 constituting the heat-generation pattern of the heat-generation layer 20*b* of the fixing film 20, including the heat-generation ring 201*c* at the center portion, is uniform at W1.

However, the outer magnetic core 30*a* needs to have a certain length for providing a region for winding the detection coil 30*c* therearound, and therefore can be larger than the width of the heat-generation ring 201*c* in some cases. In this case, the outer magnetic core 30*a* is configured to monitor a plurality of heat-generation rings 201, and the change in the current at the time of breakage of the heat-generation ring 201*c* opposing the thermistor 40 is small. That is, a plurality of heat-generation rings 201 are included in a region surrounded by the magnetic path formed by the outer magnetic core 30*a* and the inner magnetic core 30*b* in the second section. Therefore, the contribution rate of the circulating current of the heat-generation ring 201*c* to the total current value of the circulating current intersecting with the magnetic path in the region surrounded by the magnetic path becomes low. As a result of this, in some cases, it is difficult to secure the detection sensitivity of the current sensor 30 appropriate for determining the conduction failure of the heat-generation ring 201*c* opposing the thermistor 40.

Therefore, in the present embodiment, a length W3 of the outer magnetic core 30*a* in the longitudinal direction X1 and a length W4 of the inner magnetic core 30*b* in the longitudinal direction X1 are set to be different, and the length of one magnetic core among these two around which the detection coil 30*c* is not wound, that is, the inner magnetic core 30*b*, is set to be shorter. More preferably, the length W4 of the inner magnetic core 30*b* in the longitudinal direction X1 is set to be smaller than the inner width W2 of the outer magnetic core 30*a*. As a result of this, the detection sensitivity of the current sensor 30 can be secured even in the case where, for example, it is difficult to set the length W3 of the outer magnetic core 30*a* to be smaller than the width W1 of the heat-generation ring 201.

To confirm the relationship between the lengths of the outer magnetic core 30*a* and the inner magnetic core 30*b* in the longitudinal direction X1 and the detection sensitivity, an experiment was conducted in conditions shown in Table 1. In this experiment, the heat-generation ring 201*c* opposing the thermistor 40 was intentionally broken, and the change rate of the output signal of the current sensor 30 in the breakage was calculated. The number of turns of the detection coil 30*c* was set to 100, and the resistance of the shunt resistor 30*d* was set to 10 kΩ. In addition, the inner width W2 of the outer magnetic core 30*a* was set to 3 mm in all examples.

TABLE 1

| | Width W1 of heat-generation ring | Length W4 of inner magnetic core |
|---|---|---|
| Comparative Example 1 | 3 mm | 3 mm |
| Example 1 | 3 mm | 1 mm |
| Comparative Example 2 | 1 mm | 3 mm |
| Example 2 | 1 mm | 1 mm |

Figure 10A:
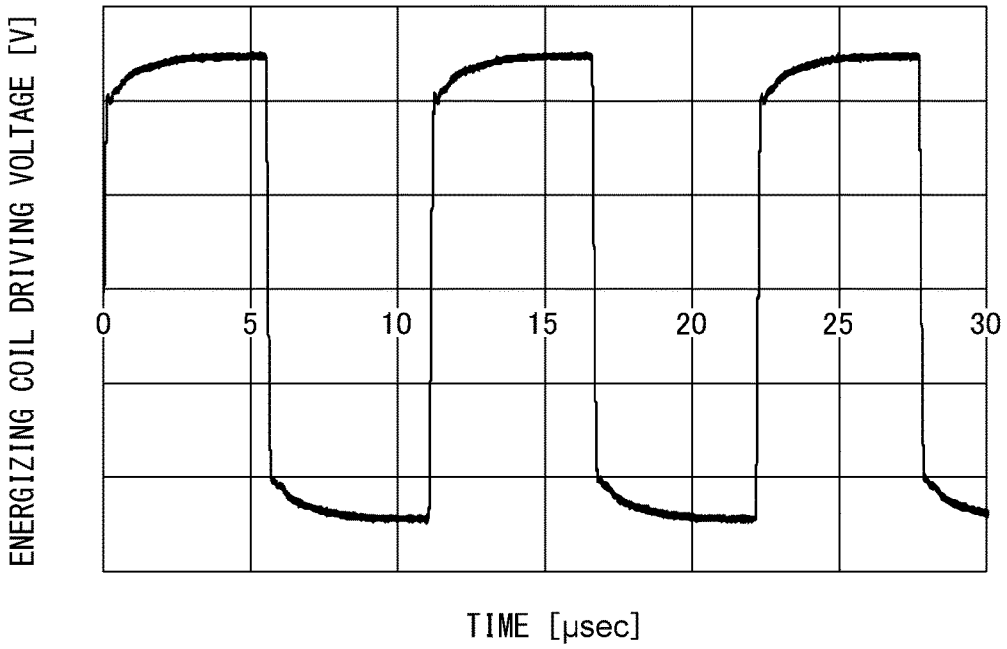
FIG. 10A is a graph showing a waveform of a driving voltage of an energizing coil according to Examples 1 and 2.

FIG. 10A illustrates a driving voltage waveform obtained when a driving current of 90 kHz was supplied to the energizing coil 27 from the energizing circuit 53 illustrated in FIG. 6, and a rectangular wave voltage having a period of about 11 μsec was obtained. An alternating magnetic field generated in accordance with this driving voltage generates an induced electromotive force in the heat-generation ring 201*c* of the fixing film 20.

Figure 10B:
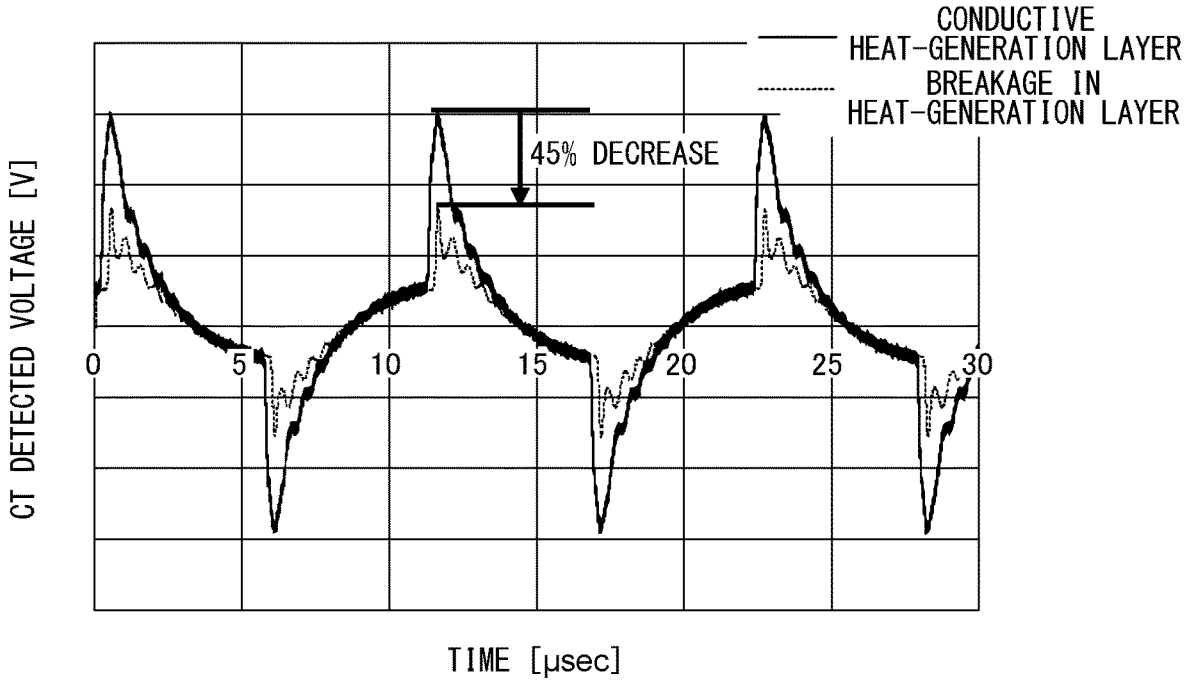
FIG. 10B is a graph showing a waveform of an output signal of the current sensor according to Examples 1 and 2.

FIG. 10B illustrates a waveform of a voltage value serving as a CT detected voltage that is an output signal of the current sensor 30 obtained by measuring the voltage between the ends of the shunt resistor 30*d*. The solid line indicates a voltage waveform obtained in the case where the heat-generation ring 201*c* opposing the thermistor 40 was not broken. The dot line indicates a voltage waveform obtained in the case where the heat-generation ring 201*c* was broken. Here, a ratio of decrease amount, by which the peak value of the output voltage of the current sensor 30 after the breakage is decreased compared to the peak value after the breakage, to the peak value before the breakage is defined as a decrease rate of the output signal of the current sensor 30. In the example of FIG. 10B, it can be seen that the output signal of the current sensor 30 decreased by 45% due to the breakage.

The measurement described above was performed and the decrease rate of the output signal of the current sensor 30 was obtained for respective configurations of Comparative Example 1, Example 1, Comparative Example 2, and Example 2 shown in Table 1. The results are shown in Table 2.

TABLE 2

| | Decrease rate of output signal |
|---|---|
| Comparative Example 1 | 45% |
| Example 1 | 50% |
| Comparative Example 2 | 15% |
| Example 2 | 40% |

As can be seen from Table 2, in the case where the inner magnetic core 30*b* was shortened, that is, where the core width of the inner magnetic core 30*b* was reduced, the decrease rate of output signal of the current sensor 30 increased. This can be seen from comparison between Example 1 and Comparative Example 1 and comparison between Example 2 and Comparative Example 2. That is, by setting the inner magnetic core 30*b* to be shorter than the outer magnetic core 30*a* in the longitudinal direction X1, the detection sensitivity of the current sensor 30 was improved, and the breakage detection performance of the conduction monitoring device including the current sensor 30 was improved. Further, as can be seen from the fact that the improvement rate of Example 2 from Comparative Example 2, which is 40/15, is higher than the improvement rate of Example 1 from Comparative Example 1, which is 50/45, setting the inner magnetic core 30*b* to be shorter in the longitudinal direction X1 is particularly effective in the case where the width of the heat-generation patter is small.

Here, the decrease rate of the output signal at the time of breakage is supposed to be approximately 100% if the current sensor 30 monitors only the heat-generation ring 201*c* that is broken. However, the decrease rate is about 50% at highest in the examples and comparative examples described above. The reason for this can be considered that the detection coil 30*c* received the influence of an excess magnetic flux generated by a circulating current flowing in heat-generation rings 201 that were not broken and were adjacent to the heat-generation ring 201*c* that was broken.

That is, in the present embodiment, unlike a normal CT current sensor illustrated in FIG. 7 in which a magnetic core is disposed to surround the measurement target conductor in the circumferential direction, the magnetic core is divided by the fixing film 20. Therefore, it is considered that part of the magnetic flux Φ passing through the outer magnetic core 30*a* and the inner magnetic core 30*b* is distributed in a path including heat-generation rings 201 adjacent to the heat-generation ring 201*c* serving as a detection target, for example, in a path indicated as magnetic field lines Φ0 in FIG. 8. Therefore, it is difficult to completely eliminate the influence of the heat-generation rings 201 adjacent to the heat-generation ring 201*c* serving as a detection target.

Therefore, the measurement was performed again for a configuration in which a shielding member that surrounds the outer magnetic core 30*a* is additionally provided such that the detection coil 30*c* is not influenced by the excess magnetic flux generated by a source different from the heat-generation ring 201*c* as much as possible.

Figure 11:
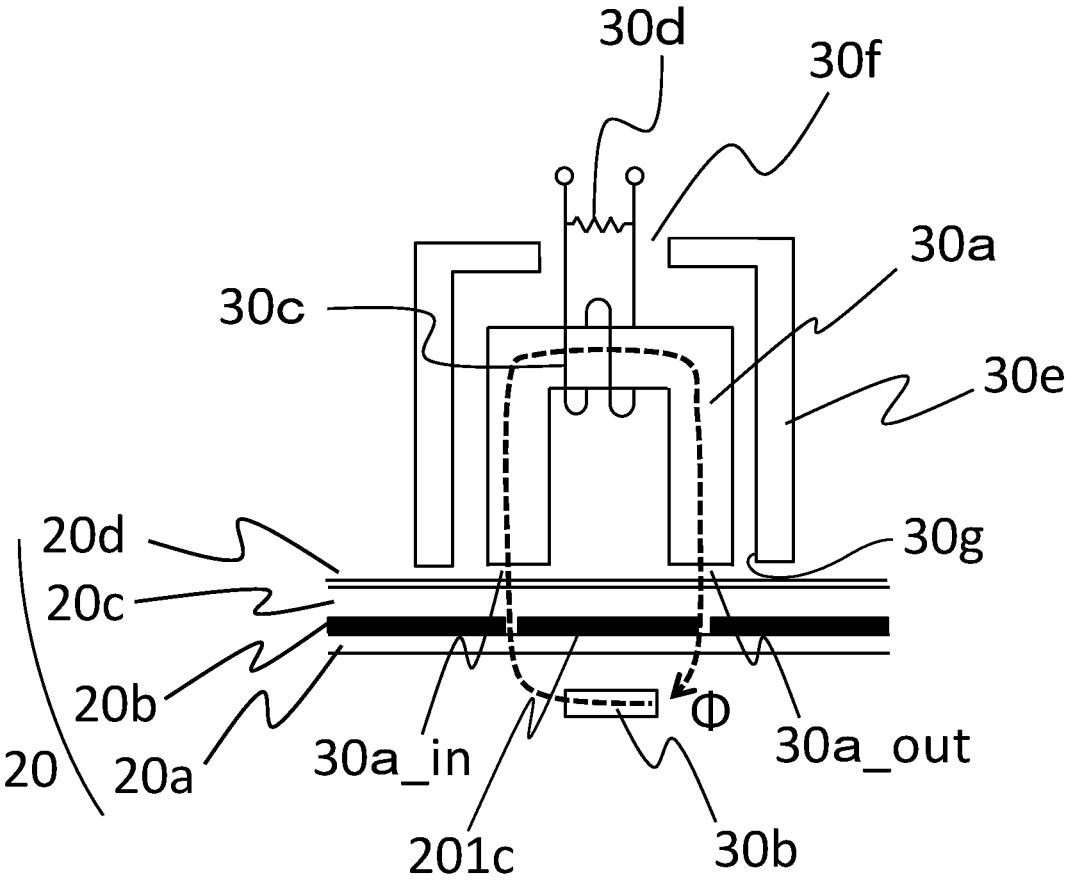
FIG. 11 is a schematic diagram illustrating a configuration of a current sensor according to Examples 3 and 4.
Figure 12:
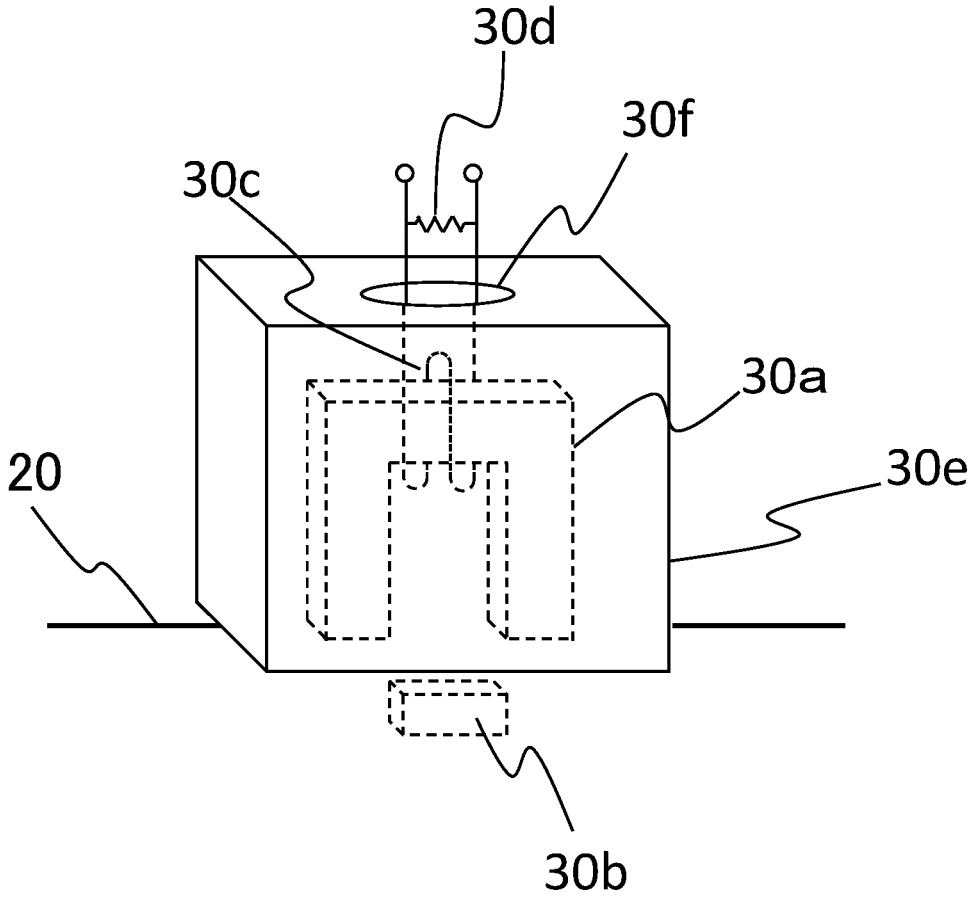
FIG. 12 is another schematic diagram illustrating a configuration of the current sensor according to Examples 3 and 4.

FIGS. 11 and 12 are respectively a section view and a perspective view of the current sensor 30 illustrating a configuration thereof in which a magnetic shield 30*e* is additionally provided. The magnetic shield 30*e* is disposed to oppose at least one face of the outer magnetic core 30*a* excluding an opposing face of the outer magnetic core 30*a* opposing the fixing film 20, so as to surround the outer magnetic core 30*a* and the detection coil 30*c* and has an opening portion 30*g* on the magnetic flux entrance 30*a*_in and the magnetic flux exit 30*a*_out side such that entry of the magnetic flux Φ is not hindered. In addition, the magnetic shield 30*e* has an opening portion 30*f* provided on the upper surface side in FIG. 11 for drawing out a wire from the detection coil 30*c*. The other elements of the current sensor 30 such as the outer magnetic core 30*a*, the inner magnetic core 30*b*, the detection coil 30*c*, and the shunt resistor 30*d* are the same as those described above with reference to FIGS. 8 to 10.

From the viewpoint of shielding the outer magnetic core 30*a* by absorbing an excess magnetic flux, a soft magnetic material having high magnetic permeability, for example, a soft magnetic metal material such as ferrite, permalloy, or silicon steel is preferably used as a material for the magnetic shield 30*e*. Therefore, a magnetic shield having a thickness of 2 mm and formed from ferrite was used this time.

To confirm the effect of the magnetic shield 30*e*, as shown in Table 3, the decrease rate of the output signal of the current sensor 30 at the time of breakage was calculated in the same conditions as in the case described above where the magnetic shield 30*e* was not provided. That is, the number of turns of the detection coil 30*c* was 100, and the resistance of the shunt resistor 30*d* was 10 kΩ. In addition, the inner width W2 of the outer magnetic core 30*a* was set to 3 mm in all examples.

TABLE 3

| | Width W1 of heat-generation ring | Length W4 of inner magnetic core |
|---|---|---|
| Comparative Example 3 | 3 mm | 3 mm |
| Example 3 | 3 mm | 1 mm |
| Comparative Example 4 | 1 mm | 3 mm |
| Example 4 | 1 mm | 1 mm |

The decrease rate of the output signal of the current sensor 30 was obtained by performing measurement for the respective configurations of Comparative Example 3, Example 3, Comparative Example 4, and Example 4 in substantially the same manner as in Table 2. The results are shown in Table 4.

TABLE 4

| | Decrease rate of output signal |
|---|---|
| Comparative Example 3 | 75% |
| Example 3 | 85% |
| Comparative Example 4 | 25% |
| Example 4 | 65% |

As can be seen from Table 4, it was confirmed that as a result of the addition of the magnetic shield 30*e*, the decrease rate of the output signal at the time of breakage further increased, that is, the breakage detection performance of the conduction monitoring device was greatly improved as compared with Examples 1 and 2 described above in which the magnetic shield 30*e* was not provided. Further, it was also confirmed that the effect of setting the width of the inner magnetic core 30*b* to be short also increased.

Modification Example

In the embodiment described with reference to FIGS. 11 and 12, a magnetic material is employed as the material for the magnetic shield 30*e*. Note that, from the viewpoint of shielding the outer magnetic core 30*a* by reflecting an excess magnetic flux, the shielding effect can be also obtained by employing a conductive material, for example, a metal of high conductivity such as aluminum or copper. In addition, a soft magnetic material and a metal may be used in combination.

In addition, although an I-shaped magnetic core is used as the inner magnetic core 30*b* in the embodiment described above, the configuration is not limited to this. For example, also in the case where the shape of the inner magnetic core 30*b* is set to the U shape employed for the outer magnetic core 30*a*, a similar effect can be obtained by setting the length thereof in the longitudinal direction X1 to be small and setting the inner width to be small.

In addition, although the detection coil 30*c* is formed on the outer magnetic core 30*a* in the embodiment described above, in principle, a similar effect can be obtained also by forming the detection coil 30*c* on the inner magnetic core 30*b*. However, the inner magnetic core 30*b* needs to be larger for forming the detection coil 30*c* thereon, and the diameter of the fixing film 20 needs to be increased for disposing the inner magnetic core 30*b* therein. In addition, the diameter of the fixing film 20 needs to be increased similarly in the case where a U-shaped inner magnetic core 30*b* is employed. From the viewpoint of miniaturizing the apparatus, it is preferable that the detection coil 30*c* is formed on the outer magnetic core 30*a* disposed on the outside of the fixing film 20, and it is preferable that an I-shaped inner magnetic core 30*b* is employed.

In addition, although an example in which a thermistor is used as the temperature detecting portion to block supply of power when an abnormal temperature is detected has been described in the embodiment above, the temperature detecting portion is not limited to this. A similar effect can be obtained by using a thermo switch having a mechanism of blocking a current by inversion of a bi-metallic strip at a predetermined temperature, a thermal fuse that blocks a current by operation of a spring mechanism caused by fusion of a pellet, or the like.

In addition, although the fixing film 20 formed from a flexible film material has been described as an example of a cylindrical rotary member having a heat-generation layer in the embodiment described above, a stiff cylindrical rotary member may be also used.

To be noted, although the width W1 of the heat-generation ring 201 illustrated in FIG. 8 is set to 3 mm in the examples shown in Tables 1 to 4 described above, the width W1 of the heat-generation ring 201 and the pattern width of the heat-generation layer 20*b*, which is obtained by adding the width of an insulating portion between the heat-generation rings 201 to W1, can be arbitrarily changed. In this case, it is preferable that the design is changed while maintaining the relative magnitude relationship between the width W1 of the heat-generation ring 201 and the lengths of the outer magnetic core 30*a* and the inner magnetic core 30*b* of the current sensor 30.

Other Embodiments

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2020-010967, filed on Jan. 27, 2020, which is hereby incorporated by reference herein in its entirety.

What is claimed is:

1. A fixing apparatus configured to heat a toner image on a recording material and fix the toner image to the recording material, the fixing apparatus comprising:

a rotary member that is cylindrical and is configured to come into contact with the recording material, including a heat-generation layer being conductive and comprising a plurality of rings each continuous in a circumferential direction of the rotary member, the plurality of rings being electrically separated from one another in a rotation axis direction of the rotary member;

a magnetic field generator disposed on an inner circumferential side of the rotary member and configured to, by being supplied an alternating current, generate an alternating magnetic field to induce a circulating current flowing in the circumferential direction in each of the plurality of rings of the heat-generation layer;

a temperature sensor configured to detect a temperature of the rotary member;

a conduction detecting unit configured to detect a conduction failure in an opposing ring that is one of the plurality of rings of the heat-generation layer and that opposes the temperature sensor; and a controller configured to control supply and interruption of power to the magnetic field generator on a basis of detection results of the temperature sensor and the conduction detecting unit, wherein the conduction detecting unit includes:

a first magnetic core disposed on an outer circumferential side of the rotary member;

a second magnetic core disposed on the inner circumferential side of the rotary member and configured to form, together with the first magnetic core, a magnetic path surrounding the circulating current flowing in the opposing ring; and a current detecting portion including a detection coil wound around one of the first magnetic core and the second magnetic core and configured to output a signal corresponding to the circulating current flowing in the opposing ring, and wherein a length in the rotation axis direction of the one of the first magnetic core and the second magnetic core around which the detection coil is wound is greater than a length in the rotation axis direction of another of the first magnetic core and the second magnetic core around which the detection coil is not wound.

2. The fixing apparatus according to claim 1, wherein the length in the rotation axis direction of the another of the first magnetic core and the second magnetic core around which the detection coil is not wound is less than a width in the rotation axis direction of the opposing ring.

3. The fixing apparatus according to claim 1, wherein the length in the rotation axis direction of the one of the first magnetic core and the second magnetic core around which the detection coil is wound is greater than a width in the rotation axis direction of the opposing ring.

4. The fixing apparatus according to claim 1, wherein the one of the first magnetic core and the second magnetic core around which the detection coil is wound is the first magnetic core.

5. The fixing apparatus according to claim 4, wherein the first magnetic core includes:

a first portion which extends in the rotation axis direction and around which the detection coil is wound;

a second portion which extends toward the rotary member from a first end of the first portion in the rotation axis direction; and a third portion which extends toward the rotary member from a second end of the first portion in the rotation axis direction, and wherein the length of the second magnetic core in the rotation axis direction is less than a distance between the second portion and the third portion in the rotation axis direction.

6. The fixing apparatus according to claim 1, further comprising a magnetic shield disposed to oppose at least one face of the first magnetic core excluding an opposing face of the first magnetic core opposing the rotary member, the magnetic shield being configured to reduce an influence, on the first magnetic core, of a magnetic flux generated from a source different from the opposing ring.

7. The fixing apparatus according to claim 6, wherein at least part of the magnetic shield is formed from a soft magnetic material.

8. The fixing apparatus according to claim 6, wherein at least part of the magnetic shield is formed from a conductive material.

9. The fixing apparatus according to claim 1, wherein the controller is configured to cause an interruption of power supplied to the magnetic field generator in a case where the temperature of the rotary member detected by the temperature sensor is equal to or higher than a predetermined temperature and in a case where the conduction failure in the opposing ring is detected by the conduction detecting unit.

10. An image forming apparatus comprising:

an image forming unit configured to form a toner image on a sheet; and the fixing apparatus according to claim 1 configured to fix the toner image formed by the image forming unit to the sheet.

* * * * *